US007832818B1

(12) United States Patent
McElfresh

(10) Patent No.: US 7,832,818 B1
(45) Date of Patent: Nov. 16, 2010

(54) INKJET PEN WITH PROXIMITY INTERCONNECT

(75) Inventor: David K. McElfresh, San Diego, CA (US)

(73) Assignee: Oracle America, Inc., Redwood City, CA (US)

( * ) Notice: Subject to any disclaimer, the term of this patent is extended or adjusted under 35 U.S.C. 154(b) by 333 days.

(21) Appl. No.: 11/121,993

(22) Filed: May 3, 2005

(51) Int. Cl.
*B41J 29/38* (2006.01)
*B41J 2/05* (2006.01)

(52) U.S. Cl. ..... 347/5; 347/9; 347/57; 347/58

(58) Field of Classification Search ..... 347/5, 347/9, 57, 58
See application file for complete search history.

(56) References Cited

U.S. PATENT DOCUMENTS

| | | | | |
|---|---|---|---|---|
| 3,949,410 | A * | 4/1976 | Bassous et al. | 347/75 |
| 5,629,838 | A * | 5/1997 | Knight et al. | 361/782 |
| 6,068,367 | A * | 5/2000 | Fabbri | 347/49 |
| 6,231,165 | B1 * | 5/2001 | Komuro | 347/58 |
| 6,557,976 | B2 | 5/2003 | McElfresh et al. | 347/50 |
| 6,705,705 | B2 | 3/2004 | Horvath et al. | 347/50 |
| 6,728,113 | B1 * | 4/2004 | Knight et al. | 361/760 |
| 6,843,552 | B2 | 1/2005 | McElfresh et al. | 347/50 |
| 6,916,719 | B1 * | 7/2005 | Knight et al. | 438/381 |
| 6,945,632 | B2 * | 9/2005 | Nakamura et al. | 347/58 |
| 7,106,079 | B2 * | 9/2006 | Drost et al. | 324/754 |
| 2003/0020787 | A1 * | 1/2003 | Nakamura et al. | 347/57 |

OTHER PUBLICATIONS

Drost et al., "Proximity Communication," *IEEE 2003 Custom Integrated Circuits Conference*, 0-7803-7842-3/03 (2003) pp. 469-472.
Drost et al., "Proximity Communication," *IEEE Journal of Solid-State Circuits*, vol. 39, No. 9 (2004) pp. 1529-1535.
Drost et al., "Proximity Communication," *2004 Sun Labs Open House*, Sun Microsystems, Inc. (2004) pp. 1-28.

* cited by examiner

*Primary Examiner*—Julian D Huffman
(74) *Attorney, Agent, or Firm*—Martine Penilla & Gencarella, LLP

(57) ABSTRACT

An inkjet pen includes a print head comprising a substrate, a plurality of inkjet nozzles formed into the substrate, integrated circuitry on the substrate for driving the inkjet nozzles, and a proximity interconnect transceiver formed into the substrate for receiving print data. An interconnect chip having a counterpart proximity interconnect transceiver passes the print data to the print head using capacitive coupling.

8 Claims, 4 Drawing Sheets

INKJET PEN WITH PROXIMITY INTERCONNECT

BACKGROUND

Inkjet pens generally comprise a carrier that supports a print head comprising a silicon die containing a plurality of nozzles for ejecting ink. For example, a single die may have as many as 1200 nozzles each individually controlled using circuitry on board the die. The circuitry receives data from an external controller over interconnect wires which may comprise wire bonding, tape automated bonding (TAB) or other known conventional interconnect technology.

The interconnect wires are generally protected against contacting the ink using an encapsulating material. However, the encapsulating material may be subject to degradation resulting from contact with the corrosive inks that are handled by the inkjet pen. When the encapsulation material is attacked by the ink, it may expose the interconnection wires which then become shorted or corroded themselves.

FIG. 1 shows an exemplary inkjet pen 10 according to the prior art. Inkjet pen 10 is a wide-area inkjet pen having a plurality of print heads 20 arranged in a staggered relationship to cover a larger area of the print media with each pass. Each print head 20 comprises a silicon substrate with a plurality of nozzles 22 formed therein. The print heads 20 are wire bonded to flexible printed circuit board 14, which bends over a corner of carrier 12. Electrical contacts 18 are provided on a second surface of carrier 12 well away from print heads 20 to prevent contact with ink, which could short circuit the connections. Electrical contacts 18 are used to provide electronic communication between print heads 20 and an external controller circuit (not shown). Ink is provided via port 21 from an ink supply (not shown). The ink passes through a manifold 16 and enters each print head 20 from underneath.

FIG. 2 shows a cross section view of inkjet pen 30 having a single print head 20. The single print head will typically be responsible for printing a single color ink, so that for the typical four-color system having cyan, yellow, magenta, and black (CYMK) inks, four print heads will be provided, typically arranged adjacent one another. Print head 20 includes wire bond sites at either end to provide signal communication over wire bonds 24. Wire bonds 24 are encapsulated by encapsulating material 26. The bonds provide a connection between print head 20 and ceramic substrate 14 so that print head 20 can receive print data. Ceramic substrate may be any ceramic material with electrical traces provided thereon. Alternatively, a rigid circuit board may be used. The print data is interpreted using processor circuitry in print head 20 to generate signals for firing each nozzle at appropriate times to eject a droplet of ink onto a print media such as a sheet of paper. The use of processor circuitry allows for a reduction in the number of wire bonds needed to supply the necessary data for the large number of nozzles on board print head 20. For example, a print head having 1200 nozzles may require tens of connections to supply it with necessary data and power to operate.

Because the electrical connections are so close to the print nozzles, the encapsulating material comes into contact with ink which attacks the material. As print resolution increases, and as technology advances in print head design resulting in increased printing speed, more and faster electrical connections have become necessary to handle increased data throughput. Increased wire bond connections result in lower yields in production. Furthermore, as the number of interconnects increases, the likelihood that one or several interconnections will become shorted by the ink and/or corroded beyond use increases, which reduces the expected life of the pen. This problem is exacerbated by the advent of more aggressive inks, which are provided to improve clarity on a variety of media.

In light of the above, it would be desirable to provide some interconnect technology that provides reliable high speed electronic communication to a ink jet pen which is less vulnerable to corrosion and shorting than the currently available technologies.

SUMMARY

Broadly speaking, the present invention fills these needs by providing an inkjet pen with proximity interconnect technology.

It should be appreciated that the present invention can be implemented in numerous ways, including as a process, an apparatus, a system, a device, or a method. Several inventive embodiments of the present invention are described below.

In one embodiment, a print head comprises a substrate, a plurality of inkjet nozzles formed into the substrate, integrated circuitry on the substrate for driving the inkjet nozzles, and a proximity interconnect transceiver formed into the substrate for receiving print data.

In another embodiment, an inkjet pen comprises a carrier and a print head attached to the carrier. The print head comprises a substrate including a plurality of inkjet nozzles formed into the substrate, integrated circuitry on the substrate for driving the inkjet nozzles, and a first proximity interconnect transceiver formed into the substrate for receiving print data. The pen further comprises an interconnect chip having proximity interconnect logic for passing print data from a plurality of electrical pads to a second proximity interconnect transceiver, the second proximity interconnect transceiver being in electronic communication with the first proximity interconnect transceiver using capacitive coupling.

In yet another embodiment, a method for ink jet printing comprises passing print data in the form of electrical signals to an interconnect chip, passing the print data from the interconnect chip to the print head using capacitive coupling, and firing ink jet print nozzles in accordance with the print data to eject ink onto a print media.

Other aspects and advantages of the present invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION

In the following description, numerous specific details are set forth in order to provide a thorough understanding of the present invention. However, it will be apparent to one skilled in the art that the present invention may be practiced without some of these specific details. In other instances, well known process operations have not been described in detail in order to avoid unnecessarily obscuring the invention.

Figure 1:
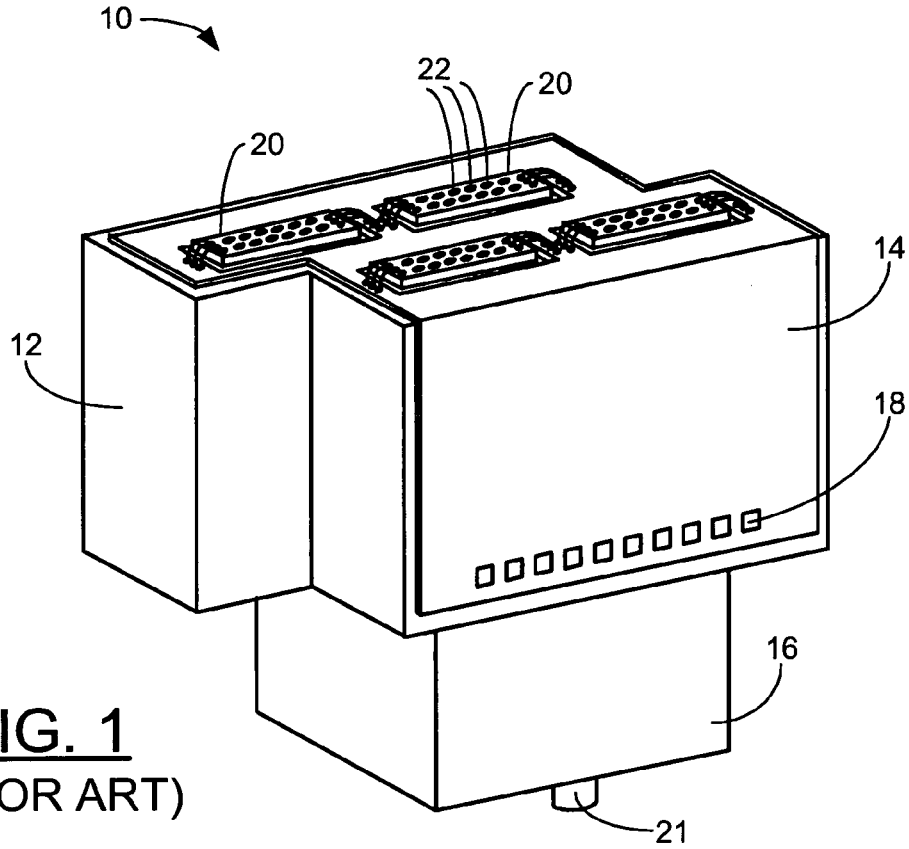
FIG. 1 (PRIOR ART)
FIG. 1 presents a prior art inkjet pen.
Figure 2:
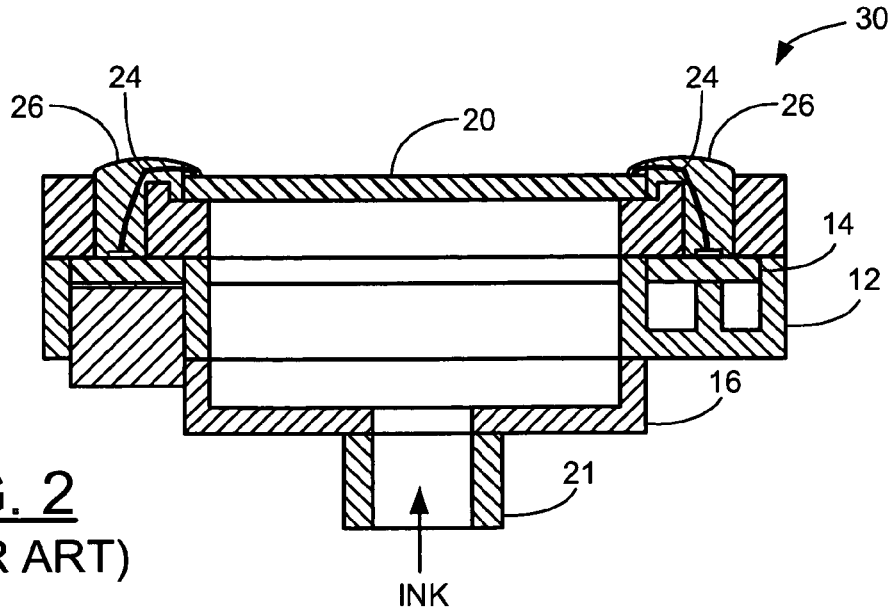
FIG. 2 (PRIOR ART)
FIG. 2 shows a prior art inkjet pen in cross section.
Figure 3:
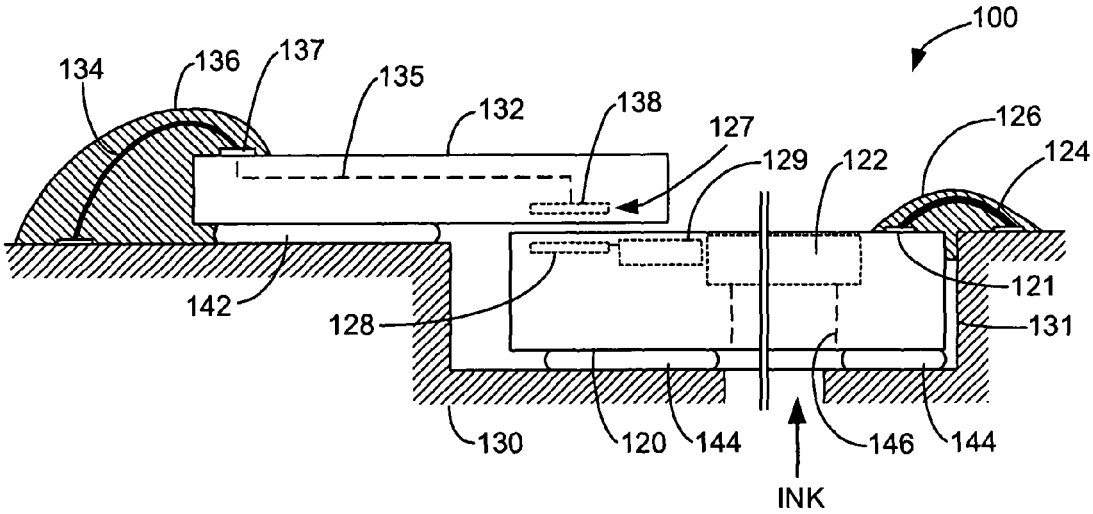
FIG. 3 shows an inkjet pen using a proximity interconnection.

FIG. 3 shows an inkjet pen 100 having a proximity interconnection. Inkjet pen 100 is not shown to scale so that various structural details can be seen clearly. Print head 120 is mounted to a substrate 130 by bonding or by using some adhesive material 144 suitable for use in inkjet pens as generally known in the art. Substrate 130 may include a rigid or flexible circuit board or a laminate structure having a layer removed to create a recess 131 in which print head 120 is positioned. It should be noted that, for a color system, inkjet pen 100 may include a plurality of print heads, one for each color being printed. Furthermore, a plurality of print heads of each color may be provided in a staggered configuration for wide area printing.

As is generally known in the art, print head 120 includes a plurality of nozzles 122 for printing ink onto print media (not shown) such as a sheet of paper. Ink enters print head 120 via an opening in substrate 130 aligned with ink intake 146 on the bottom side of print head 120. Print head 120 includes logic circuitry 129 for interpreting electronic communication and generating firing signals for nozzles 122 at appropriate times. Logic circuitry 129 is in electronic communication with proximity interconnect transceiver 128 which communicates with proximity interconnect transceiver 138 in interconnect chip 132. Thus, logic circuitry 129 receives print data using interconnect transceiver 128.

Print head 120 requires electrical power to drive logic circuitry 129 and fire ink nozzles 122. Electrical power is provided over electrical connections 124 (only one shown) which is shown in the form of a wire bond. Electrical connection 124 could also be achieved by tape automated bonding (TAB) or other available technology. To allow for the needed current, multiple wire bonds can be applied or thicker wire can be used. By providing wire bonding to multiple sites, spatial redundancy can help ensure a reliable electrical connection. A plurality of voltages may be provided for different circuit portions contained by print head 120. Electrical connections 124 are encapsulated by encapsulating material 126. Because of the increased redundancy, the electrical power connections are not as vulnerable to catastrophic failure from corrosion by contact with the ink as ordinary signal lines would be in the same location.

Interconnect chip 132 includes a corresponding proximity interconnect transceiver 138 to transmit and receive communications to and from print head 120. Information is transferred through interconnect chip 132 to and from proximity interconnect transceiver 138 by electrical conductors 135 within interconnect chip 132 thereby placing the proximity interconnect transceiver 138 in electrical communication with contact pads 137. Wire bonds 134 provide a connection between contacts pads 137 and the substrate 130. Wire bonds 134 are encapsulated in encapsulation material 136. Because the wire bonds 134 are farther away (spaced apart) from nozzles 122, and therefore the ink, they are less likely to come into contact with ink and are therefore unlikely to corrode significantly over the life of print head 120. Other bonding technologies, such as tape automated bonding (TAB), are contemplated as well.

Figure 4:
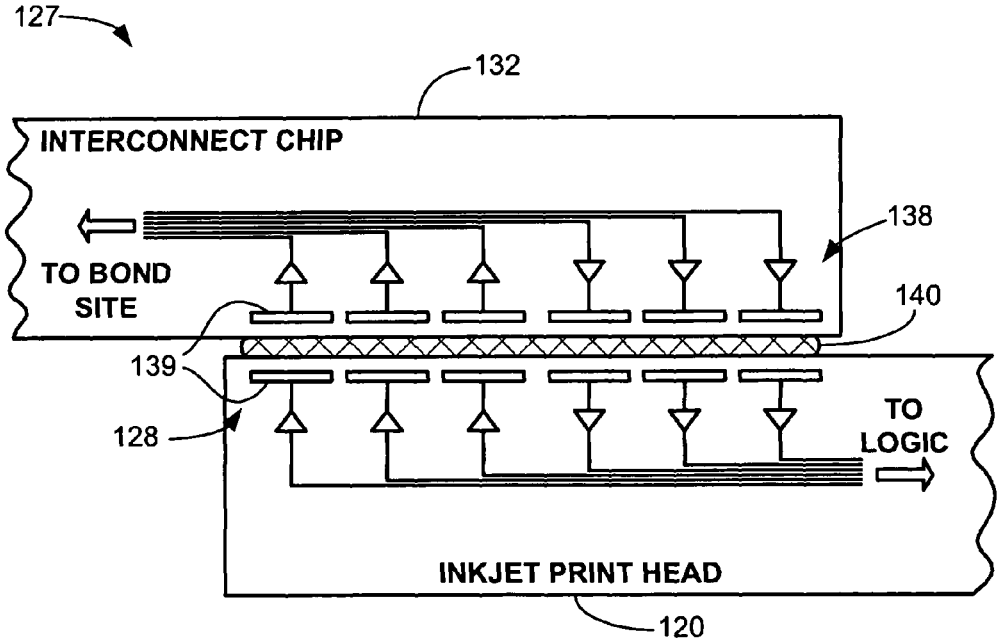
FIG. 4 shows a schematic representation of a proximity interconnection.

Proximity interconnection 127 comprises corresponding proximity interconnect transceivers 128 and 138 to send and receive electrical signals that provide the basis for communication between adjacent integrated circuits. FIG. 4 shows a close-up schematic view of proximity interconnection 127. Each transceiver 128, 138 comprise a plurality of transmitters and a plurality of receivers. The transmitter and receiver are close to each other and communicate by capacitive coupling rather than through large off-chip wires. The transmitter and receiver pads 139 are protected from exposure to corrosive materials such as inks as well as electrostatic discharge events and short circuits by a top layer dielectric and passivation. For example, a dielectric material such as silicon oxide or glass may be deposited by chemical vapor deposition. Dielectric adhesive 140 suitable for use in the inkjet pen environment, such as an epoxy, ensures no relative movement between proximity interconnect transceivers 128, 138. Note that adhesive 140 is not generally necessary since both print head 120 and interconnect chip 132 are mounted to a substrate 130 (FIG. 3) with transmitter and receiver pads 139 in alignment.

Additional details on proximity interconnect technology is available from Drost, Robert J. et al., "Proximity Communication," *IEEE Custom Integrated Circuits Conference*, pp. 469-471, 2003 and Drost, Robert J. et al., "Proximity Communication," *IEEE Journal of Solid-State Circuits*, Vol. 39, No. 9, pp. 1529-1535, September 2004, which are incorporated herein by reference.

Figure 5:
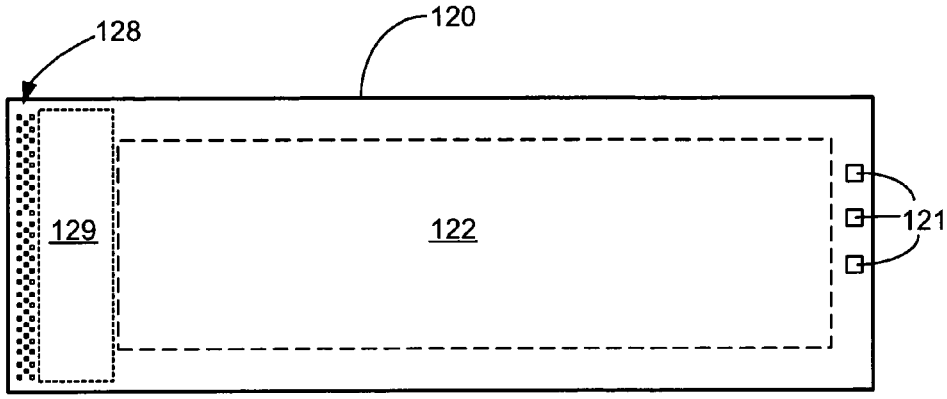
FIG. 5 shows a schematic plan view of a print head for use with a proximity interconnection.

FIG. 5 shows a plan view of an exemplary integrated circuit print head 120 comprising a plurality of nozzles 122, logic circuitry 129, proximity interconnect transceiver 128, and power connection pads 121. Print head 120 is generally elongated with a proximity interconnect transceiver 128 at one short end and power connection pads 121 at an opposite end. However, other configurations are possible. For example, proximity interconnect transceiver 128 may be provided on a long-side of print head 120, proximity interconnect transceiver 128 and power connection pads may be provided on a common side. Many other possibilities will occur to those skilled in the art.

Figure 6:
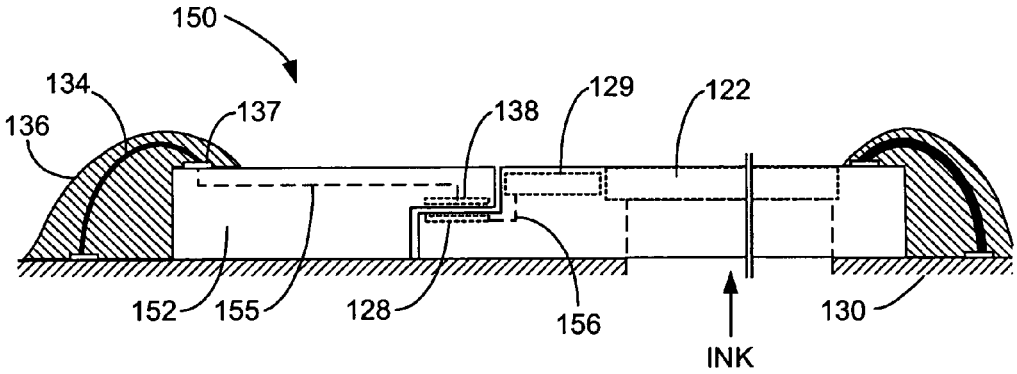
FIG. 6 shows a second embodiment of an inkjet pen having a proximity interconnection.

FIG. 6 shows an embodiment of an inkjet pen wherein print head 154 is in communication with interconnect chip 152 at a landing of a step structure 156 formed into one or both of print head 154 and interconnect chip 152 (both shown as stepped). Step structure 156 is formed by removing substrate material from a top surface of the print head. It is also possible to form a step by removing material from a bottom surface of the print head, in which case proximity interconnect transceiver 128 would face down (not shown). In the exemplary embodiment, a step or shoulder structure is formed at one short edge of print head 154 to form a portion of reduced height. A proximity interconnect transceiver is formed into the shoulder and a corresponding proximity interconnect transceiver is formed into interconnect chip 152. This structure allows print nozzles 122 to be moved closer to the print media (not shown). Proximity interconnect transceiver 138 is connected to contact pads 137 by internal connections 154.

Figure 7:
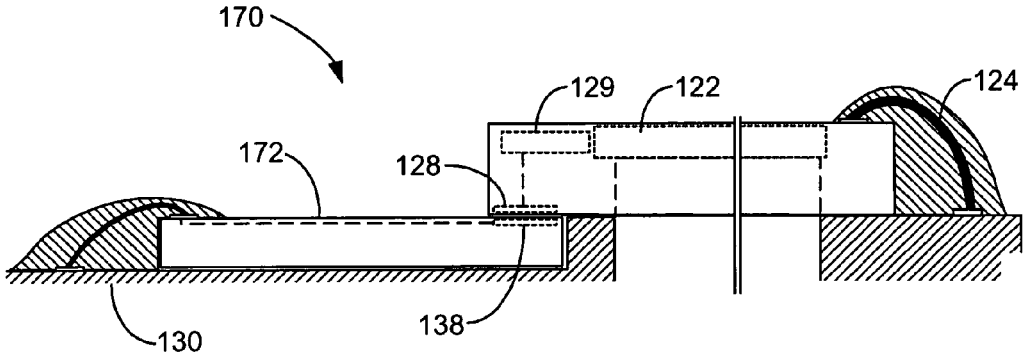
FIG. 7 shows a third embodiment of an inkjet pen having a proximity interconnection.

FIG. 7 shows another alternate embodiment wherein print head 174 has a proximity interconnect transceiver 128 positioned adjacent its lower surface at one end of the print head. By forming carrier 130 with a step, print head 174 overhangs at the location of the proximity interconnect transceiver, allowing interconnect chip 172 to communicate via a corresponding proximity interconnect transceiver 138.

Figure 8:
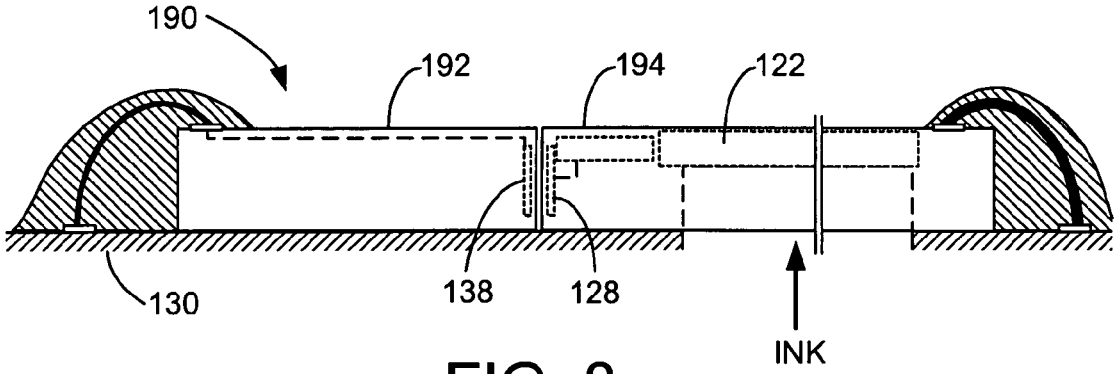
FIG. 8 shows a fourth embodiment of an inkjet pen having a proximity interconnection.

FIG. 8 shows another alternate embodiment wherein print head 194 provides a proximity interconnect transceiver 128 oriented vertically on one edge. Print head 194 is abutted with interconnect chip 192, thereby bringing a corresponding proximity interconnect transceiver 138 into alignment with proximity interconnect transceiver 128, allowing the two to communicate. To form the capacitive plates of interconnect transceiver, it would be possible to form a via a the location of the dicing operation and then passivate or deposit a dielectric material after dicing to form the dielectric layer for capacitive coupling.

Figure 9:
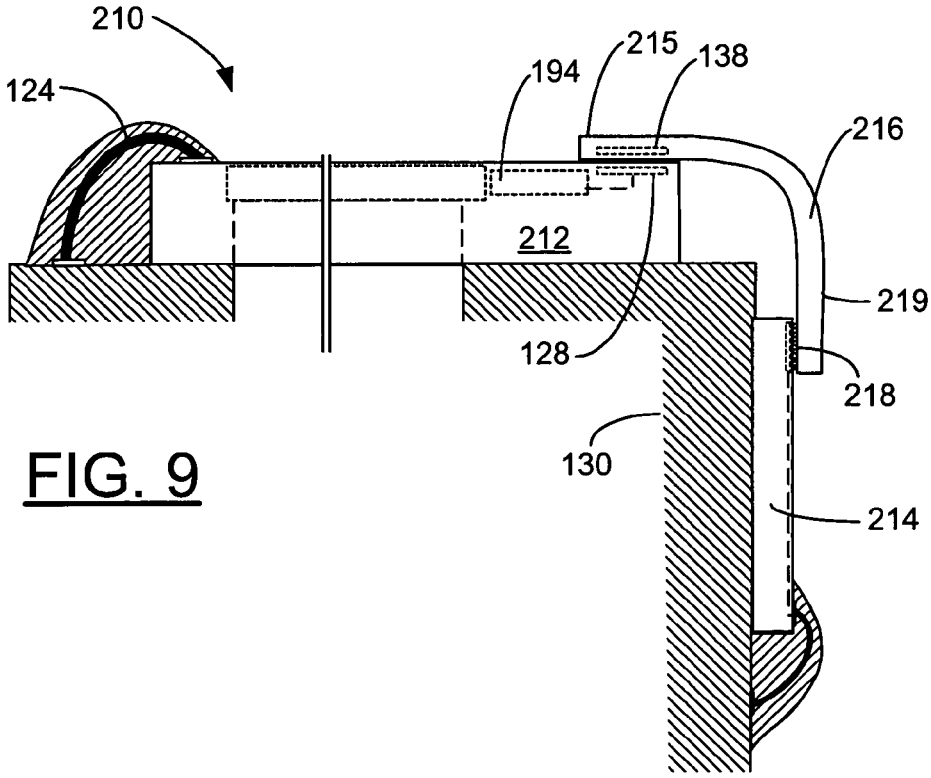
FIG. 9 shows a fifth embodiment of an inkjet pen having a proximity interconnection.

FIG. 9 shows yet another alternate embodiment. In this case, carrier 130 includes a bend to form two surfaces. On one surface, print head 212 is provided with power connection 124 on one end and a proximity interconnect transceiver 128 at another end. In proximity with proximity interconnect transceiver 128 is proximity interconnect transceiver 138, which is formed into flex connector 216. Flex connector 216 is a flexible printed circuit connector with proximity interconnection at one end 215 and solder sites formed into the opposite end 219. Opposite end 219 is soldered to contact sites 218 formed into interconnect chip 214. Alternatively, wire bonding, TAB bonding, or secondary proximity connections are possible in place of solder contact sites 218. Interconnect chip 214 contains circuitry necessary for the proximity interconnect communication to take place and bonding pads for wire bonds 134.

It should be noted that, while the various embodiments are shown using wire bond connectors, other connection types including Tape Automated Bonding (TAB). Furthermore, since the proximity interconnect technology provides a possibility of high density, high-speed connections, some processing could be performed on the interconnection ship.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. An inkjet pen comprising:

a print head including, a plurality of inkjet nozzles, integrated circuitry for driving the inkjet nozzles, and a first proximity interconnect transceiver in electrical communication with the integrated circuitry;

a semiconductor chip including, a second proximity interconnect transceiver defined on a first side of the semiconductor chip that is oriented toward and adjacent to the first proximity interconnect transceiver to define capacitive coupling, and a conductor defined within the semiconductor chip, the conductor defined to couple the second proximity interconnect transceiver to a bond pad defined on a second side of the semiconductor chip, the conductor placing the bond pad at a spaced apart orientation that is away from the inkjet nozzles;

a wire bond coupled to the bond pad for carrying print data, the wire bond connecting at the spaced apart orientation that is away from the inkjet nozzles, such that the spaced apart orientation reduces exposure to ink corrosion of the wire bond and of encapsulation covering the wire bond; and a dielectric adhesive in contact with both the print head and the semiconductor chip, the dielectric adhesive being aligned between the first and the second proximity interconnect transceivers.

2. The inkjet pen of claim 1, wherein the semiconductor chip is spaced-apart from the print head and the first proximity interconnect transceiver is spaced-apart from the second proximity interconnect transceiver.

3. The inkjet pen of claim 1, further including power connection pads, in electrical communication with the integrated circuitry, disposed on a second end of the print head, with the second end being disposed opposite to a first end where the first proximity interconnect transceiver is located, the plurality of inkjet nozzles being positioned between the first and second ends, the integrated circuitry being disposed between the first end and the plurality of inkjet nozzles, wherein the plurality of inkjet nozzles are formed between the power connection pads and the first proximity interconnect transceiver.

4. The inkjet pen of claim 1, wherein the first and the second proximity interconnect transceivers further include transmit and receive pads, the transmit and receive pads being protected from exposure to corrosive materials by a top dielectric and passivation layer.

5. An inkjet pen comprising:

a carrier;

a print head attached to the carrier;

a plurality of inkjet nozzles formed into the print head;

integrated circuitry on the print head for driving the inkjet nozzles;

a first proximity interconnect transceiver formed into the print head for receiving print data destined for the integrated circuit;

a semiconductor chip comprising electrical pads, a conductor, and a second proximity interconnect transceiver, the electrical pads passing the print data to the second proximity interconnect transceiver through the conductor, the second proximity interconnect transceiver being in electronic communication with the first proximity interconnect transceiver using capacitive coupling, with the semiconductor chip being spaced-apart from the print head, the conductor placing the electrical pads at a spaced apart orientation that is away from the inkjet nozzles, such that the spaced apart orientation reduces exposure to ink corrosion of a wire bond connected to the electrical pads and of encapsulation covering the wire bond; and a dielectric adhesive in contact with both the print head and the semiconductor chip, the dielectric adhesive being aligned between the first and the second proximity interconnect transceivers.

6. The inkjet pen of claim 5 wherein the second proximity interconnect transceiver is formed on the semiconductor chip which is positioned adjacent the print head so that the first and second proximity interconnect transceivers are in electronic communication.

7. The inkjet pen of claim 6 wherein the nozzles are formed into a top surface of the print head and the first proximity interconnect transceiver is formed into the top surface of the print head, a portion of the semiconductor chip overlaying the print head to place the first and second proximity interconnect transceivers in electronic communication.

8. A method for ink jet printing, the method comprising:

passing print data in the form of electrical signals to an interconnect chip;

passing print data through a conductor from a bond pad in a first end in the interconnect chip to a first capacitive coupler in a second end in the interconnect chip, the conductor placing the bond pad at a spaced apart orientation that is away from ink jet print nozzles, with the interconnect chip being spaced-apart from the ink jet print nozzles, such that the spaced apart orientation reduces exposure to ink corrosion of a wire bond connected to the bond pad and of encapsulation covering the wire bond;

passing the print data from the first capacitive coupler to a second capacitive coupler in a print head using capacitive coupling to drive logic circuitry included in the print head, wherein a dielectric adhesive in contact with both the print head and the interconnect chip is aligned between the first and the second capacitive couplers; and firing the ink jet print nozzles contained in the print head in accordance with the print data to eject ink onto a print media.

* * * * *